US007226036B1

(12) United States Patent
Wellman, Jr.

(10) Patent No.: US 7,226,036 B1
(45) Date of Patent: Jun. 5, 2007

(54) FRAME MOVING APPARATUS AND METHOD

(76) Inventor: William A. Wellman, Jr., 27146 Belltrees Rd., Godfrey, IL (US) 62035

( * ) Notice: Subject to any disclaimer, the term of this patent is extended or adjusted under 35 U.S.C. 154(b) by 93 days.

(21) Appl. No.: 11/210,447

(22) Filed: Aug. 25, 2005

(51) Int. Cl.
*B66F 3/00* (2006.01)

(52) U.S. Cl. ..... 254/15; 254/120; 254/131

(58) Field of Classification Search ..... 254/15, 254/120, 131, 131.5, 113, 17, 134, 21
See application file for complete search history.

(56) References Cited

U.S. PATENT DOCUMENTS

| | | | | |
|---|---|---|---|---|
| 1,482,989 | A * | 2/1924 | Hering | 254/15 |
| 1,918,017 | A | 7/1933 | Christ | |
| 3,653,115 | A * | 4/1972 | Perkins | 29/237 |
| 4,021,979 | A | 5/1977 | Rez | |
| 4,178,668 | A * | 12/1979 | George | 29/237 |
| 4,620,691 | A | 11/1986 | Waters, Jr. | |
| 4,765,771 | A | 8/1988 | Howsley | |
| 5,685,115 | A | 11/1997 | Colfer | |
| 5,893,255 | A | 4/1999 | Lee | |
| 6,089,554 | A * | 7/2000 | Berardino | 269/130 |
| 2002/0113230 | A1 * | 8/2002 | Creel et al. | 254/131 |

* cited by examiner

*Primary Examiner*—Lee D. Wilson

(57) ABSTRACT

A frame moving apparatus includes a first plate having a top side and a bottom side. A second plate has a top side and a bottom side. A plurality of gripping members is attached to and extends downwardly from the bottom sides of the first and second plates. A post extends upwardly from the top side of the first plate. A handle has a lower end attached to the top side of the second plate. An elongated member has a first end pivotally coupled to the handle and a second end attached to the post. A fixed surface is gripped with the second plate and a wall frame is gripped with the first plate. An upper end of the handle is moved toward or away from the first plate so that the wall frame is moved in a same direction as the upper end of the handle.

6 Claims, 4 Drawing Sheets

FRAME MOVING APPARATUS AND METHOD

BACKGROUND OF THE INVENTION

1. Field of the Invention

The present invention relates to frame moving devices and more particularly pertains to a new frame moving device for assisting a person in the movement of a wall frame.

2. Description of the Prior Art

The use of frame moving and alignment devices is known in the prior art. U.S. Pat. No. 4,021,979 describes an aligning bracket device for aligning pre-cast concrete structures. Another type of alignment device is U.S. Pat. No. 5,893,255. A device for moving floor boards during the construction of a wood floor is found in U.S. Pat. No. 1,916,017.

While these devices fulfill their respective, particular objectives and requirements, the need remains for a device and method that assists a person in moving a wall frame. Such a device would be used when aligning a wall frame with a particular wall line or could also be used when positioning the wall frame in a perpendicular relationship with a fixed wall frame. The device could be used to hold the wall frame in place while it is being secured.

SUMMARY OF THE INVENTION

The present invention meets the needs presented above by generally comprising a first plate having a top side and a bottom side. A plurality of gripping members is attached to and extends downwardly from the bottom side. A second plate has a top side and a bottom side. A plurality of gripping members is attached to and extends downwardly from the bottom side of the second plate. A post is attached to and extends upwardly from the top side of the first plate. A handle has a lower end and an upper end. The lower end is attached to the top side of the second plate. An elongated member has a first end and a second end. The first end is pivotally coupled to the handle and the second end is attached to the post. A fixed surface is gripped with the gripping members attached to the second plate and a wall frame is gripped with the gripping members attached to the first plate. The upper end of the handle is moved toward or away from the first plate so that the first plate and the wall frame are each moved in a same direction as the upper end of the handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
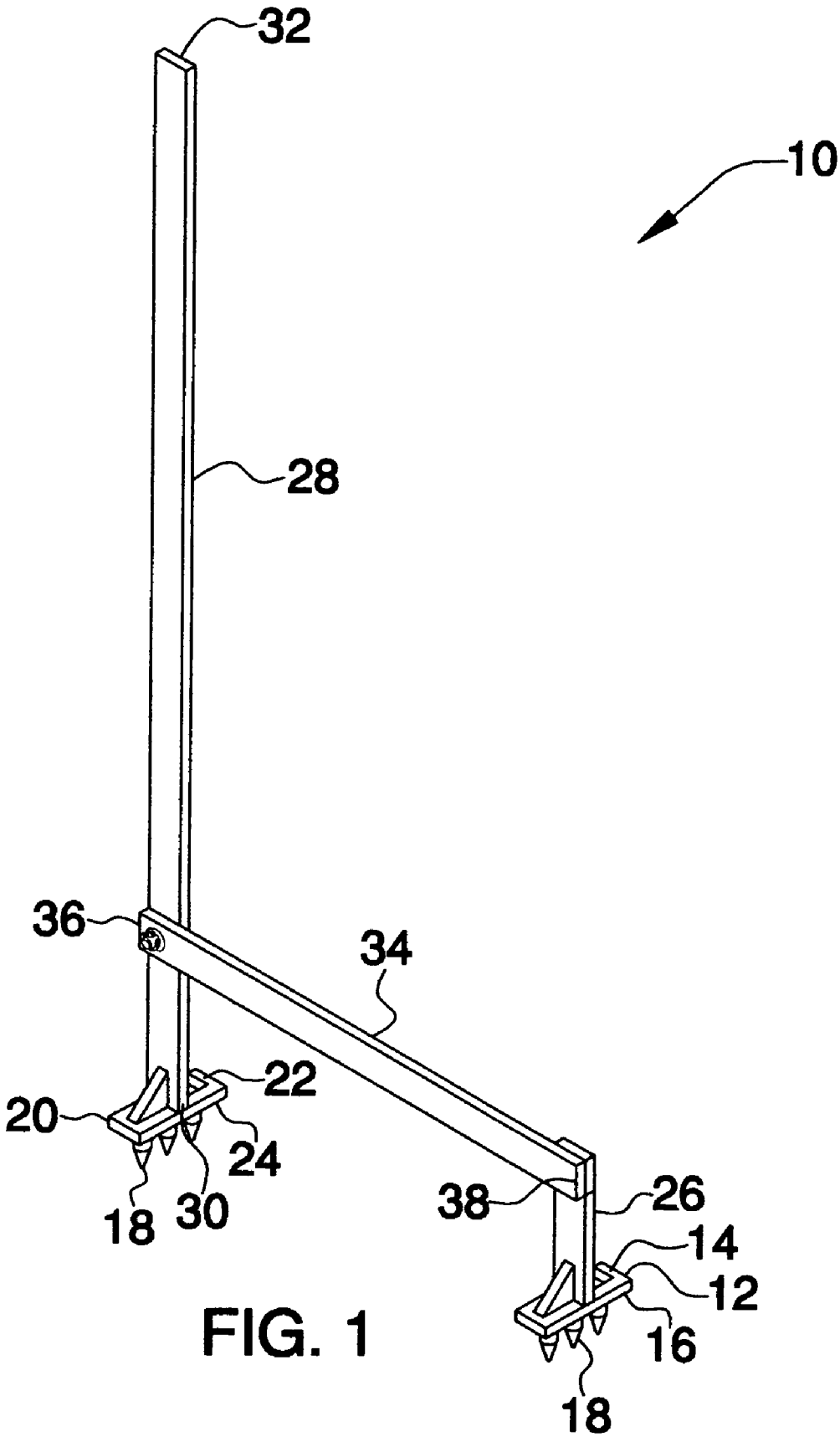
FIG. 1 is a perspective view of a frame moving apparatus and method according to the present invention.
Figure 2:
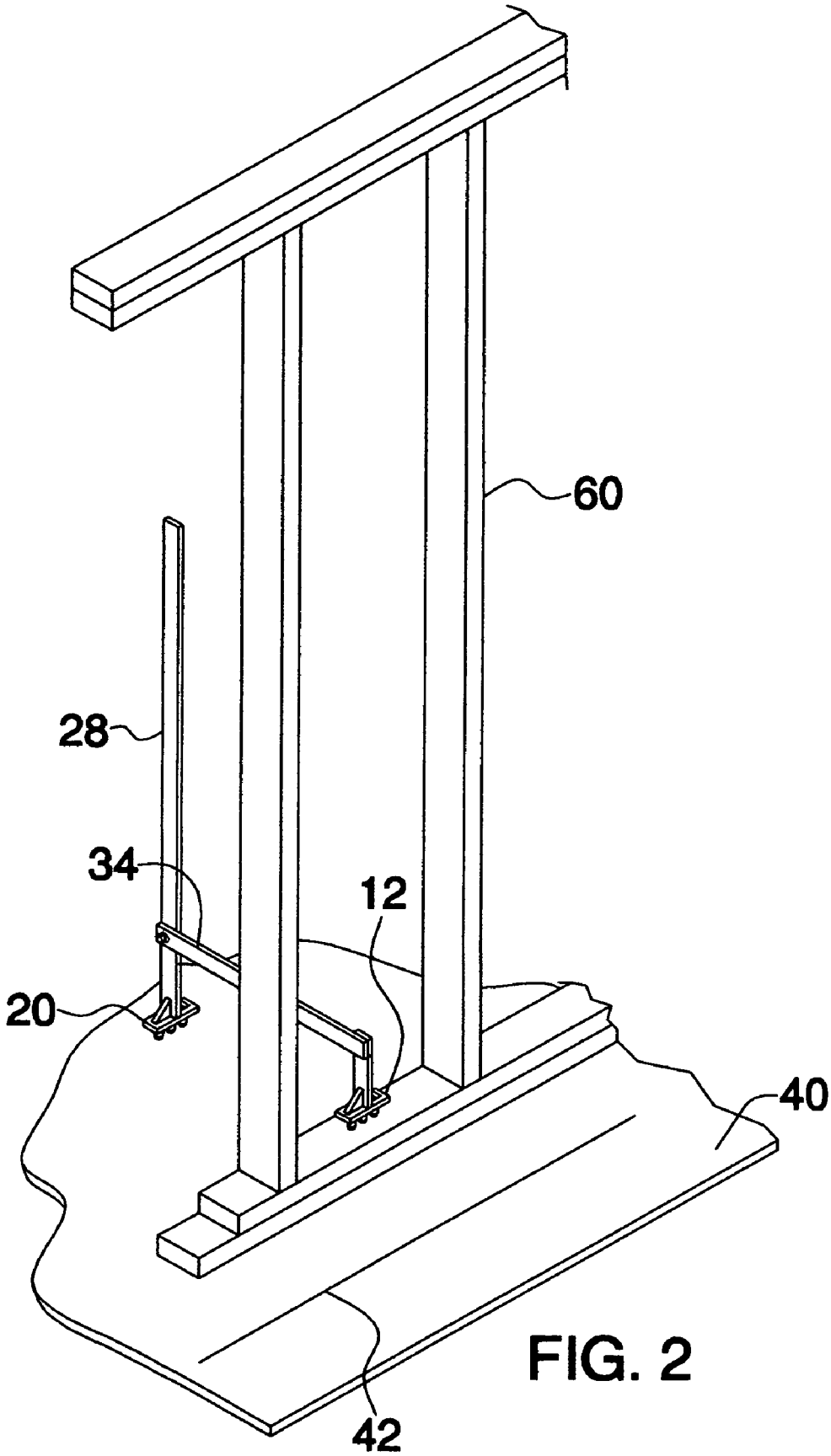
FIG. 2 is a perspective in-use view of the present invention.
Figure 3:
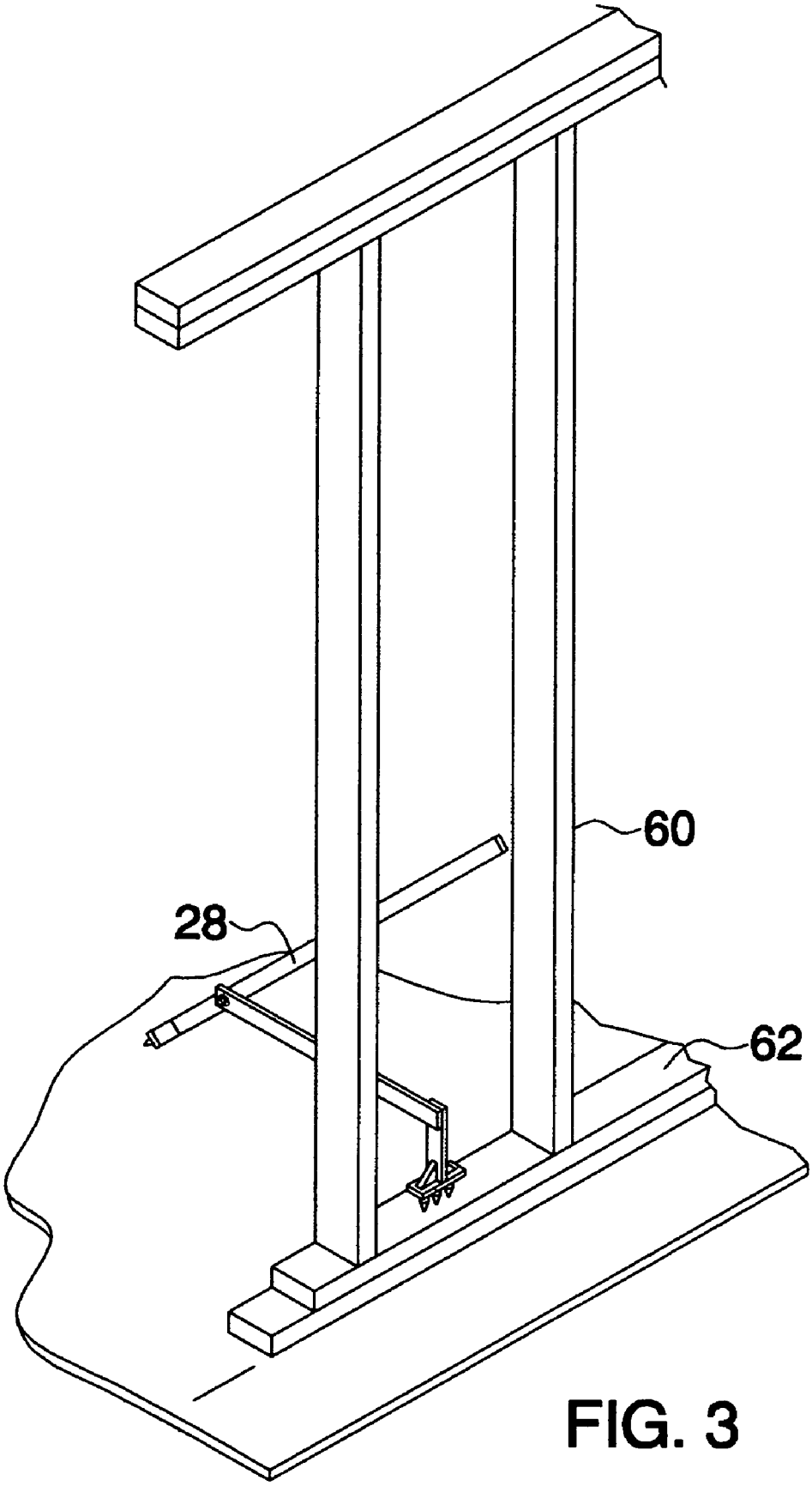
FIG. 3 is a perspective in-use view of the present invention.
Figure 4:
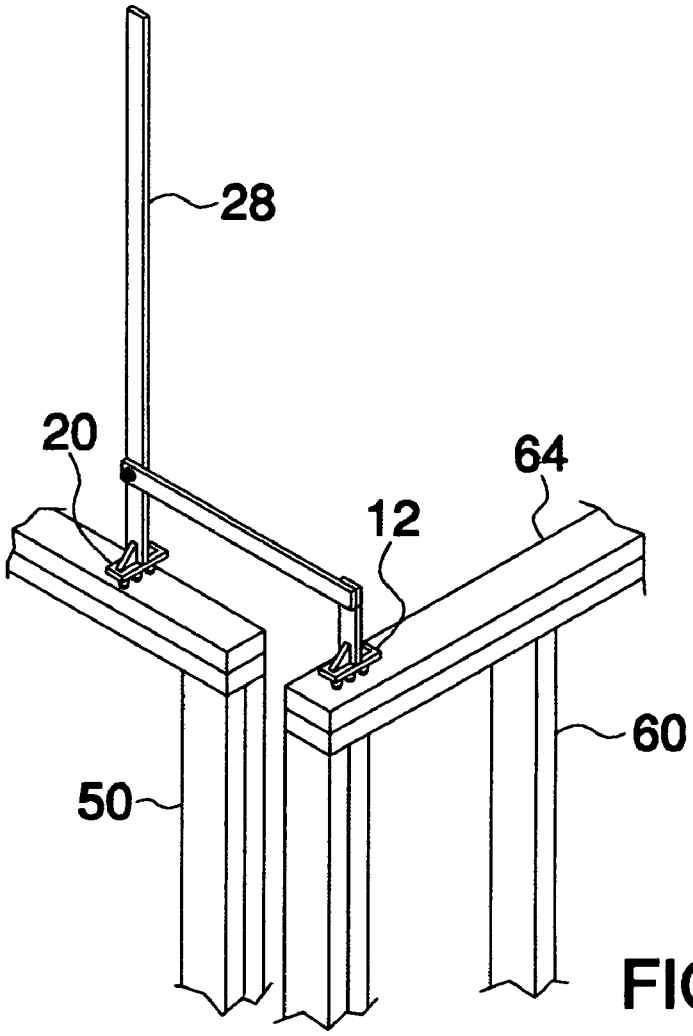
FIG. 4 is a perspective in-use view of the present invention.
Figure 5:
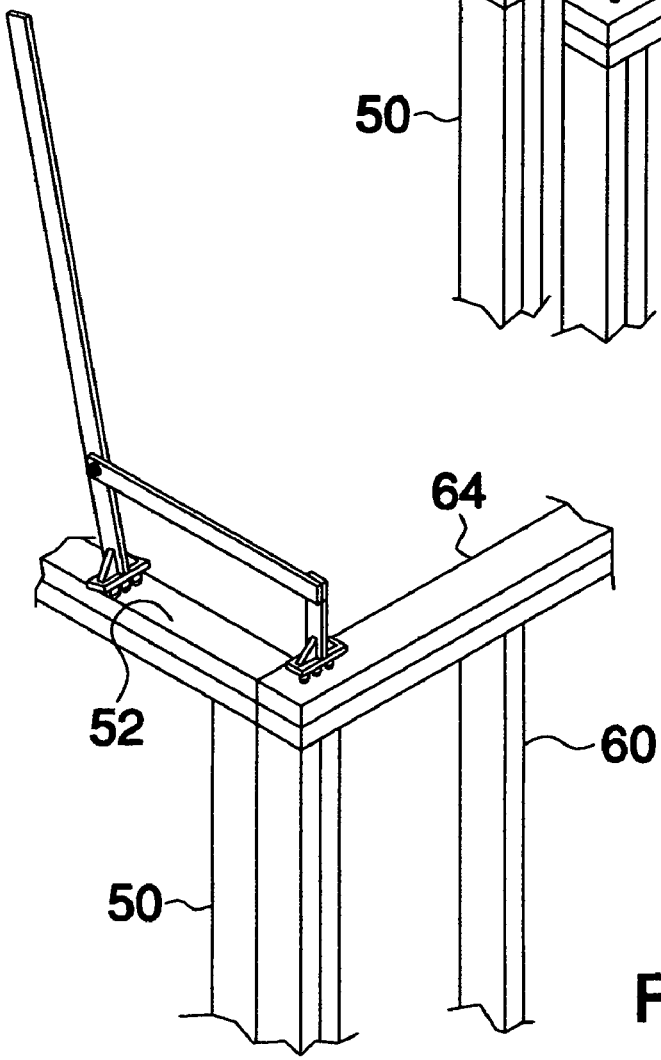
FIG. 5 is a perspective in-use view of the present invention.

With reference now to the drawings, and in particular to FIGS. 1 through 5 thereof, a new frame moving device embodying the principles and concepts of the present invention and generally designated by the reference numeral 10 will be described.

As best illustrated in FIGS. 1 through 5, the frame moving apparatus and method 10 generally comprises a first plate 12 that has a top side 14 and a bottom side 16. A plurality of gripping members 18 is attached to and extends downwardly from the bottom side 16. A second plate 20 has a top side 22 and a bottom side 24. A plurality of gripping members 18 is attached to and extends downwardly from the bottom side 24 of the second plate 20. The gripping members 18 attached to the first 12 and second 20 plates comprise spikes.

A post 26 is attached to and extends upwardly from the top side 14 of the first plate 12. A handle 28 has a lower end 30 and an upper end 32. The lower end 30 is attached to the top side 22 of the second plate 20. The handle 28 has a height greater than a height of the post 26. The post 26 has a height preferably less than 1 foot while the handle 28 preferably has a height greater than 3 feet. An elongated member 34 has a first end 36 and a second end 38. The first end 36 is pivotally coupled to the handle 28 nearer to the lower end 30 than the upper end 32 and the second end 38 is attached to the post 26. The elongated member 34 is generally horizontally orientated when the handle 28 is vertically orientated. The elongated member 34 has a length generally between 1 foot and 3 feet. The post 26, handle 28, first plate 12 and second plate 20 are each preferably comprised of a metallic material, such as steel.

In use, a fixed surface 40 or 52 is gripped with the gripping members 18 attached to the second plate 20. The fixed surface may be a flooring section 40 or an upper edge 52 of a secured wall frame 50. A wall frame 60 is gripped with the gripping members 18 attached to the first plate 12. The wall frame 60 may be gripped along its bottom portion 62 if the fixed surface is flooring 40 or may be gripped along its upper edge 64 if the fixed surface is a fixed wall frame 50. The upper end 32 of the handle 28 is then moved toward or away from the first plate 12 so that the first plate 12 and the wall frame 60 are each moved in a same direction as the upper end 32 of the handle 28. In this manner, the wall frame 60 may be moved into a perpendicular relationship with a fixed frame 50 or into alignment with a particular line 42.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of moving a wall frame, said method comprising the steps of:

providing a first plate having a top side and a bottom side, a plurality of gripping members being attached to and extending downwardly from said bottom side;

providing a second plate having a top side and a bottom side, a plurality of gripping members being attached to and extending downwardly from said bottom side of said second plate;

providing a post being attached to and extending upwardly from said top side of said first plate;

providing a handle having a lower end and an upper end, said lower end being attached to said top side of said second plate;

providing an elongated member having a first end and a second end, said first end being pivotally coupled to said handle, said second end being attached to said post;

gripping a fixed surface with said gripping members attached to said second plate;

gripping a wall frame with said gripping members attached to said first plate; and moving said upper end of said handle toward or away from said first plate such that the first plate and the wall frame are each moved in a same direction as said upper end of said handle.

2. The method according to claim 1, wherein each of said gripping members attached to said first and second plates comprises a plurality of spikes.

3. The method according to claim 1, wherein said elongated member is generally horizontally orientated when said handle is vertically orientated.

4. A method of moving a wall frame, said method comprising the steps of:

providing a first plate having a top side and a bottom side, a plurality of gripping members being attached to and extending downwardly from said bottom side, said gripping members comprising spikes;

providing a second plate having a top side and a bottom side, a plurality of gripping members being attached to and extending downwardly from said bottom side of said second plate, said gripping members attached to said second plate comprising spikes;

providing a post being attached to and extending upwardly from said top side of said first plate;

providing a handle having a lower end and an upper end, said lower end being attached to said top side of said second plate, said handle having a height greater than a height of said post;

providing an elongated member having a first end and a second end, said first end being pivotally coupled to said handle nearer to said lower end than said upper end, said second end being attached to said post, said elongated member being generally horizontally orientated when said handle is vertically orientated;

gripping a fixed surface with said gripping members attached to said second plate;

gripping a wall frame with said gripping members attached to said first plate; and moving said upper end of said handle toward or away from said first plate such that the first plate and the wall frame are each moved in a same direction as said upper end of said handle.

5. An assembly for moving a wall frame, said assembly comprising:

a first plate having a top side and a bottom side, a plurality of gripping members being attached to and extending downwardly from said bottom side;

a second plate having a top side and a bottom side, a plurality of gripping members being attached to and extending downwardly from said bottom side of said second plate;

a post being attached to and extending upwardly from said top side of said first plate;

a handle having a lower end and an upper end, said lower end being attached to said top side of said second plate, said handle having a height greater than a height of said post;

an elongated member having a first end and a second end, said first end being pivotally coupled to said handle nearer to said lower end than said upper end, said second end being attached to said post;

wherein a fixed surface may be gripped with said gripping members attached to said second plate, a wall frame may be gripped with said gripping members attached to said first plate, and said upper end of said handle may be moved toward or away from said first plate such that the first plate and the wall frame are each moved in a same direction as said upper end of said handle.

6. The assembly according to claim 5, wherein each of said gripping members attached to said first and second plates comprises a plurality of spikes.

* * * * *